US005697524A

United States Patent [19]

Sedlmeier

[11] Patent Number: 5,697,524

[45] Date of Patent: Dec. 16, 1997

[54] FOIL BAG PACKAGE INCLUDING A FOIL BAG AND BASE PART

[75] Inventor: Andreas Sedlmeier, Ummendorf, Germany

[73] Assignee: Hilti Aktiengesellschaft, Fürstentum, Liechtenstein

[21] Appl. No.: 834,696

[22] Filed: Apr. 1, 1997

Related U.S. Application Data

[63] Continuation of Ser. No. 474,840, Jun. 7, 1995, abandoned.

[30] Foreign Application Priority Data

Jan. 27, 1995 [DE] Germany ..... 295-01-255.25

[51] Int. Cl.[6] ..... B67D 5/00

[52] U.S. Cl. ..... 222/82; 222/85; 222/94; 222/105; 222/137; 222/326

[58] Field of Search ..... 222/81, 82, 85, 222/94, 95, 105, 137, 145.3, 145.5, 145.6, 326, 541.2

[56] References Cited

U.S. PATENT DOCUMENTS

| | | | |
|---|---|---|---|
| 4,493,436 | 1/1985 | Brokaw | 222/137 X |
| 4,771,919 | 9/1988 | Ernst | 222/94 X |
| 5,161,715 | 11/1992 | Grannuzzi | 222/82 |
| 5,443,182 | 8/1995 | Tanaka et al. | 222/541.2 X |

*Primary Examiner*—Joseph Kaufman
*Attorney, Agent, or Firm*—Anderson Kill & Olick P.C.

[57] ABSTRACT

A foil bag package, particularly for a mortar mass, includes at least one foil bag (1, 2) and a base part (3, 4) located at an end surface (*1a*, *2a*) of the foil bag. The base part has an outflow passage (5, 6) for conveying the mortar mass through a discharge stub (7) from the foil bag (1, 2) and a piercing device for the foil bag. The piercing device has at least two piercing spatulas (8, 9) disposed in a parallel and laterally spaced relation and approximately parallel to the axis of the outflow passage (5, 6) and located within an axial projection of the outflow passage extending towards the foil bag.

11 Claims, 1 Drawing Sheet

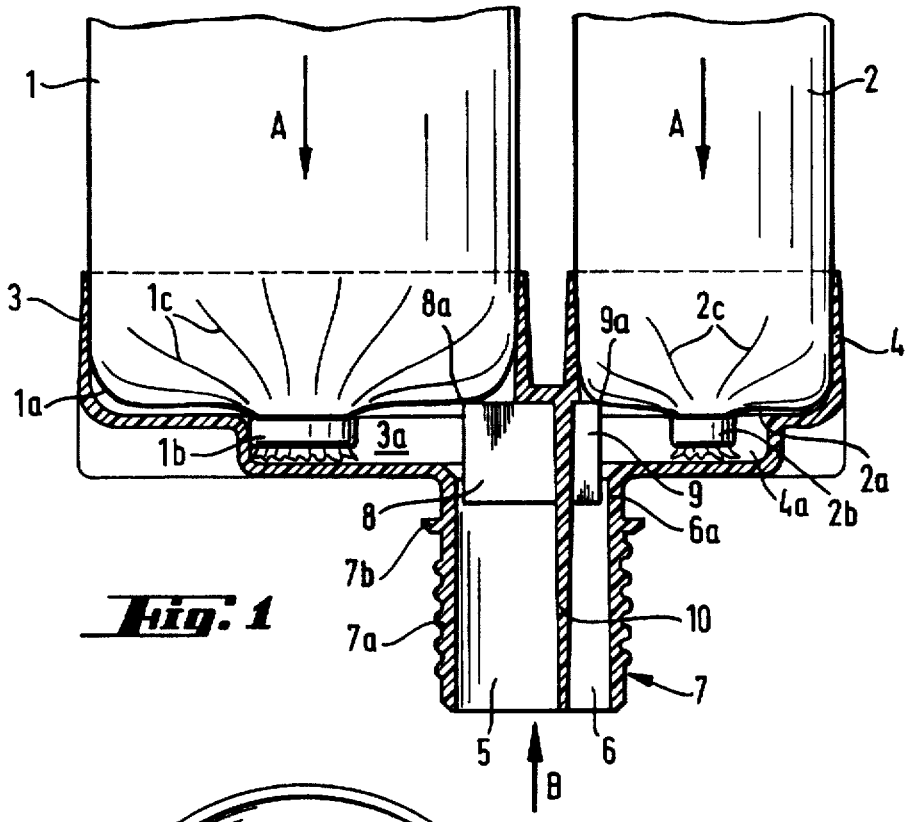
Fig. 1
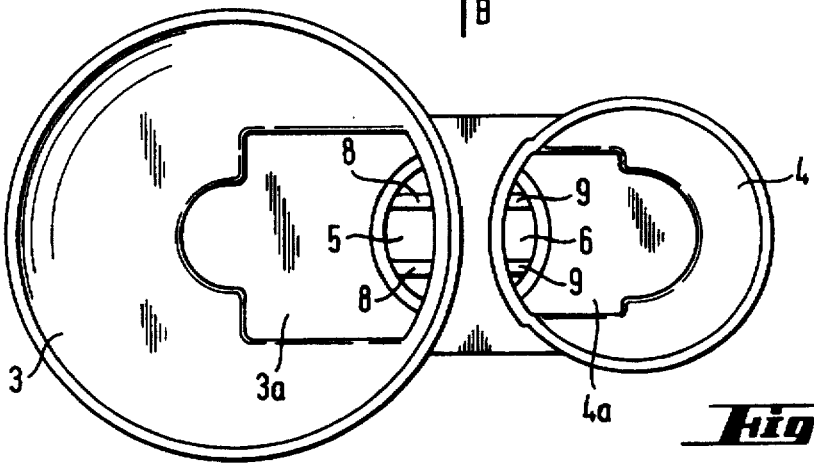
Fig. 2
Fig. 3
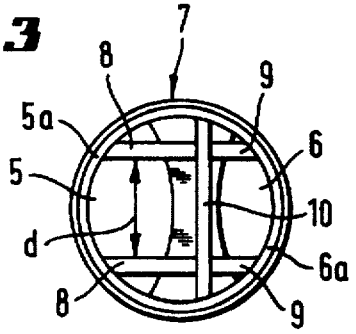
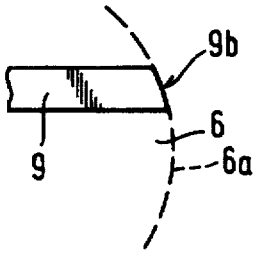
Fig. 4

FOIL BAG PACKAGE INCLUDING A FOIL BAG AND BASE PART

This is a continuation application of U.S. patent application Ser. No. 08/474,840, filed Jun. 7, 1995, now abandoned.

BACKGROUND OF THE INVENTION

The present invention is directed to a foil bag package, and particularly for mortar masses, including at least one foil bag with a base part at one end surface of the bag and with a outlet flow channel open towards the foil bag for conveying the mortar mass into an outlet stub. A piercing or puncture device for the foil bag is located in the base part.

Hardenable masses, such as mortar masses, are known as single or multiple component masses. Such masses can be utilized as spatula or spreader masses, sealing masses, adhesive masses and the like.

If adhesive masses are used, it is generally common to utilize mortar masses for fastening attachment elements. In such an arrangement, an attachment element is fixed in a recess in rock, concrete, masonry and the like with the remaining intermediate space between the attachment element and the recess filled with the mortar mass. Single or multi-component mortar masses can be used.

The mortar mass is stored in containers and is pressed out directly at the location of use. For this reason, pressing out or squeezing out devices are used which are specifically designed for such purpose. After the container is emptied, a new container must be installed in the device.

The amount of the mortar mass used is relatively large, in particular when fastening attachment elements, as mentioned above, it is intended to adequately fill the recesses of the attachment elements with the mortar mass. Because of the large quantity of the required multi-component mass, the number of emptied containers is quite large. As a result, problems arise, particularly if the containers are of a cartridge shape formed from strong material, such as plastics material. The emptied containers require a large amount of space and it is very difficult to dispose of them. For this reason, foil bags have been used as containers for holding mortar masses. Such foil bags can be pressed into a small volume after they are emptied, whereby storage of the emptied foil bags takes up an exceedingly small space. Furthermore, it is relatively easy to dispose of foil bags.

There is a disadvantage in using foil bags, because as containers they have no inherent stiffness. This factor causes problems in storage and when they are used in pressing-out or squeezing-devices. To remedy this disadvantage, it has been proposed to provide the foil bags with a base part as it is known in EP-A-0151922. Due to the use of such base parts, the foil bags can be inserted into a pressing-out device provided with a discharge mouthpiece, which is connectable to a discharge stub formed on the base part, as disclosed in EP-A-0151922.

One problem occurring when foil bags are used involves assuring a chronologically or time-wise proper opening of the foil bags permitting the mortar mass to be discharged in such a way that contamination does not result, in particular it must be assured that when the mortar mass is squeezed out of the foil bags it is not obstructed by the pressing-out device. As a result, relatively complicated and expensive piercing or rupturing devices have been known, such as disclosed in U.S. Pat. No. 3,767,085. Such devices, however, can be easily blocked and hinder the outflow of the mortar mass, if they are not subjected to thorough care and cleaning.

A piercing device for foil bags is set forth in DE-A-42 37 721 and consists of three piercing spatulas uniformly distributed at the circumference of the discharge opening. The piercing spatulas are positioned within the discharge opening and extend radially in the direction towards the center of the opening, and protrude for half the radius of the discharge opening. Because of the arrangement of the piercing spatulas, relatively large intermediate regions are formed into which the end surface of the pressurized foil bag can deviate. Therefore, it is possible that the foil bag is not opened at its end surface, but rather only in a region located further to the rear. The end surface region of the foil bag extends into the outlet opening and thus hinders or even prevents the flow of the squeezed-out mortar mass.

There is another known piercing device for foil bags in DE-A-42 26 956 formed of two piercing spatulas extending parallel to one another and arranged to follow upon the discharge opening. This piercing device is a component of the squeezing-out device and is located at the inner side of the front wall of the device containing the discharge opening. In this piercing device, the components of the squeezing-out device are contaminated with the mortar mass. Furthermore, there is the problem that the foil bag should be provided with a separate support member, to provide the stiffness required for storage and processing.

When multi-component mortar masses are used, such as two component mortar masses, there is the additional requirement that all of the foil bags must open at the same time, and that the openings be maintained during the entire squeezing-out process of each component from the foil bags. Only in this way is satisfactory intermixing afforded for effective action of the mortar mass.

SUMMARY OF THE INVENTION

Therefore, the primary object of the present invention is to provide a foil bag package consisting of a foil bag and a base part for enabling trouble-free processing of the mortar mass free of any problems and of contamination or fouling.

In accordance with the present invention, the foil bag package has a piercing device formed of at least two piercing spatulas disposed in parallel spaced relation and extending approximately parallel to the axis of the outflow passage and located within an axial projection of the outlet passage at the end surface of the foil bag.

The foil bag is supported both radially and axially by the arrangement of the piercing spatulas. Due to the pressure exerted by the pressing or squeezing out device acting on the foil bag, the region of the foil bag located between the piercing spatulas experiences a local over stretching, until the foil forming the bag bursts over a large area and "afterflow" of the foil into the outflow passage is prevented by the two piercing spatulas which hold back the foil material. A partial or complete sealing of the opening in the foil bag by the piercing spatulas, which have penetrated the foil material, cannot occur since the squeezing-out opening for the mortar mass lies in the region between the piercing spatulas. The squeezing-out device cannot be fouled by the dispensed mortar mass, since the burst region of the foil bag is located in the region of the outflow passage and the mortar mass is pressed or squeezed directly into the outflow passage.

A particular feature of the invention is that the piercing spatulas penetrate completely through the axial projection of the outflow passage resulting in a comparatively large region where the end surface of the foil bag is both axially and radially supported and retained. Accordingly, it is assured that the foil bag breaks in its end surface region.

It is particularly advantageous for overstretching the foil material between the piercing spatulas, if the spacing between the piercing spatulas amounts to approximately one-third to two-thirds of the largest diameter of the outflow passage.

In a preferred embodiment of the present invention, the narrow sides of the piercing spatulas facing the boundary wall of the outflow passage are shaped in such a way that the narrow sides are approximately tangential to the axial projection of the boundary wall of the outflow passage. In this way, the foil bag under pressure can rest or contact these areas tangentially. A portion of the piercing spatulas penetrate partially or completely through the foil material pressed against the spatulas, whereby the foil material is held in position. Therefore, an even more pronounced local overstretching in the region between the piercing spatulas occurs and promotes rupture or bursting of the foil bag in this region.

The penetration of the piercing spatulas into the foil bag is assisted, in a preferred manner, when a free-edge of the spatulas facing the foil bag extend at least to the end surface of the foil bag. This free edge assures a retaining function while the shaped edges of the spatulas afford a defined tearing action.

As pointed out, problems exist when a single-component as well as a multi-component mass is used. Based on the present invention, the piercing arrangement eliminates the disadvantages inherent in single-component as well as multi-component masses.

If a multi-component mass is used, a number of foil bags are utilized corresponding to the number of the required components. Accordingly, if a two-component mortar mass is used, two bags are utilized.

To assure that both foil bags are adequately opened at the same time, when a two-component mortar mass is used, the foil bag package consists of two foil bags and two base parts connected together, whereby two piercing spatulas are arranged in the axial projection of each of the outflow passages. Since in such a mortar mass one foil bag holds the resin and the other holds the hardener, different quantities of the individual components are needed for the required mixture. To assure a non-uniform mixing ratio, it has been known to utilize foil bags with outside diameters of different sizes. The present invention can be used with such foil bags by matching the base parts and connecting the base parts together in correspondence with the outside diameters of the foil bags. At least two piercing spatulas are disposed in the axial projection of the outflow passage in each base part.

In a preferred embodiment of the present invention, the outflow passages form partial regions of the discharge stub and are separated from one another by an axially extending dividing wall. The piercing spatulas are arranged approximately perpendicularly to the dividing wall and extend towards the opposite boundary wall of the outflow passage. In this particular embodiment, the base parts connected to one another can be manufactured in a particularly simple manner.

Since the foil bags containing the components are rotationally symmetrical bodies, and since the axes of the foil bags and of the outflow passages are disposed approximately in a single plane, it is advantageous if the piercing spatulas are disposed symmetrically relative to the axial plane of symmetry extending perpendicular to the dividing wall and forming the above-mentioned plane. Such arrangement assists in affording the reliable material overstretch in the regions between the piercing spatulas as well as assisting in tearing the foil bag open.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

In the Drawings:

FIG. 1 is an axially extending view of a foil bag package embodying the present invention and shown partially in section with only a part of the foil bags being illustrated;

FIG. 2 is a plan view of the base parts of the foil bag package connected to one another and viewed in the direction of the arrows A in FIG. 1;

FIG. 3 is an end view of the base parts viewed in the direction of the arrow B; and FIG. 4 is a schematic detail of one of the piercing spatulas embodying the present invention.

DETAILED DESCRIPTION OF THE INVENTION

In FIGS. 1 and 2 a foil bag package is shown for a two-component mortar mass. The foil bag package consists of two foil bags, 1, 2 with a base portion 3, 4 for each bag located at an end surface 1*a*, 2*a* of the bags, and the base parts 3, 4 are connected together to form a single part.

In the illustrated embodiment, each of the foil bags 1, 2 has a different volume. Foil bag 1 of a larger volume is intended for a resin and foil bag 2 of a smaller volume is intended for a cooperating hardener. The foil bags are of equal length, whereby the volume difference is afforded by a smaller diameter of the foil bag 2 as compared to the diameter of the foil bag 1.

As shown in FIG. 1, each foil bag is closed by a clip 1*b*, 2*b*, in the region of the end surfaces 1*a*, 2*a*. Creases or folds 1*c*, 2*c*, extend generally radially in the end surfaces 1*a*, 2*a* of the foil bags, because of the manner in which the bags are closed. As can be seen best in FIG. 1, the base parts 3, 4 are connected together forming a single member with each base part forming an outflow passage 5, 6 for conveying the components through a discharge stub 7 in the region where the two base parts 3, 4 are connected together. Each base part 3, 4 has a piercing device for the foil bags located in the region of the outflow passages 5, 6. In accordance with the present invention, each piercing device has at least two piercing spatulas 8, 9. The piercing spatulas 8, 9 are spaced laterally apart and extend parallel to one another and to the axes of the associated outflow passages 5, 6 and extend upwardly, as viewed in FIG. 1, in the axial projection of the associated outflow passages channel 5, 6, as can be seen in FIG. 2. In the embodiment illustrated in FIG. 2 where the base parts are connected together, the piercing spatulas 8, 9 extend completely through the axial projection of the outflow passages 5, 6.

As shown in FIG. 1, each piercing spatula 8, 9 has a free edge 8*a*, 9*a* at its end facing the corresponding foil bag 1, 2 with the free edges extending up to the end surface 1*a*, 2*a* of the corresponding foil bag 1, 2.

FIG. 3 is an end view of the discharge stub 7 viewed in the direction of the arrow B in FIG. 1. For reasons of clarity, the other sections of the base parts 3, 4 are not shown. As seen in FIG. 3, the outflow passages 5, 6 form partial regions of the discharge stub 7 and are separated from one another by an axially extending dividing wall 10. Piercing spatulas 8, 9 are located in pairs extending approximately perpendicularly to the dividing wall 10 and extending towards the oppositely located boundary walls 5a, 6a of the outflow passages 5, 6. The piercing spatula pairs 8, 9 are symmetrically disposed relative to an axial plane of symmetry which extends perpendicularly to the dividing wall 10. The lateral spacing d of the piercing spatulas 8, 9 from one another is in the range of approximately one-third to two-thirds of the largest diameter of the respective outflow passage 5, 6.

As can be seen in the end view of FIGS. 2 and 3 and in particular from the schematic showing in FIG. 4 the narrow sides 9b of the piercing spatula 9 facing the boundary walls 6a of the outflow passage 6, shown in dashed lines in FIG. 4, are shaped or beveled so that the axial projection in the contact region rests approximately tangentially at the axial projection of the boundary wall 6(a) of the outflow passage 6. It is evident that this embodiment shown as an example of one of the piercing spatulas 9 is representative of all of the piercing spatulas 8, 9.

Based on the form of the piercing spatulas 8, 9, optimal conditions are afforded for opening the foil bags 1, 2 if their end surfaces 1a, 2a are pressed to an increasing extent against the free edges 8a, 9a of the piercing spatulas 8, 9 by means of a pressing force developed by a squeezing out device, not shown. The free edges 8a, 9a penetrate into the foil bags 1, 2 and hold them firmly. Due to the pressing force exerted on the foil bags, the region of the foil bags 1, 2 located between the piercing spatulas 8, 9 is stretched to a great degree and, since the foil material is prevented from any further movement by the free edges 8a, 9a it is finally overstretched and ruptures. The foil bags 1, 2 come to rest approximately tangentially against the beveled edges of the piercing spatulas 8, 9 which have the function of a defined initiation of a tear. Accordingly, the foil bags 1, 2 rupture or burst across the large area between the piercing spatulas 8, 9.

Further, as shown in FIGS. 1 and 2, the base parts 3, 4 have a recessed section 3a, 4a. These recessed sections serve to receive the clips 1b, 2b which close or seal the foil bags 1, 2. Furthermore, the discharge stub 7 extending from the two interconnected base parts 3, 4 is provided with an exterior thread 7a. Thread 7a serves for engaging an outlet mouthpiece known as such and, therefore, not shown in the drawing. Moreover, discharge stub 7 is provided with an annular stop 7b on its outside surface for axially limiting the position of the outlet mouthpiece.

Since the entire foil bag package is a throwaway part, the interconnected base parts 3, 4 along with the discharge stub 7 are formed from a plastics material. The entire foil bag package disclosed herein is formed of plastics material which simplifies its disposal, since the foil bags 1 and 2 as well as the base parts 3 and 4 are recyclable materials subject to uniform regulations.

While specific embodiments of the invention have been shown and described in detail to illustrate the inventive principles, it will be understood that the invention may be embodied otherwise without departing from such principles.

I claim:

1. Foil bag package for use in combination with a dispensinq device for a two component mortar mass comprises a foil bag (1, 2) for each component of said mortar mass, each of said foil bags having a dispensing end surface (1a, 2a), a base part (3, 4) having end sections for receiving said dispensing end surface of each of said foil bags, said base part (3, 4) comprising separate outflow passages (5, 6) for each of said components, each of said outflow passages has a flow axis extending from the corresponding said end section for conveying said components of and through an axially extending discharge stub (7) open to said end sections, and a piercing device located in each said end section for opening said foil bags (1, 2) wherein the improvement comprises that each of said piercing device comprises at least two piercing spatulas (8, 9) disposed in parallel and laterally spaced relation, said at least two spatulas being arranged in each said end section and having an axial dimension extending parallel to the flow axis of said corresponding outflow passage (5, 6), and each said outflow passage (5, 6) having an axial projection extending into the corresponding said end section towards said foil bag therein and said at least two spatulas of each said end section having a dimension perpendicular to the lateral spacing therebetween extending into said axial projection from said outflow passage.

2. Foil bag package, as set forth in claim 1, wherein said outflow passages (5, 6) have a diameter, and the lateral spacing (d) of each pair of said piercing spatulas (8, 9) is in the range of approximately one-third to two-thirds of the largest diameter of the corresponding said outflow channel passages (5, 6).

3. Foil bag package, as set forth in claim 2, wherein said discharge stub (7) has an outside wall, a dividing wall (10) extending in the axial direction of said discharge stub and extending chordally of the outside surface of such discharge stub, said outside surface of said discharge stub forming a boundary wall (5a, 6a) of said outflow passages (5, 6), said piercing spatulas (8, 9) in each said outflow passage having a narrow side facing said boundary wall (5a, 6a) of said outflow passage (5, 6), said narrow side being shaped so that the axial projection thereof facing said boundary wall extends approximately tangentially to an axial projection of said boundary wall (5a, 6a) of said outflow passage (5, 6) in said end section of said base part (3, 4).

4. Foil bag package, as set forth in claim 3, wherein said piercing spatulas (8, 9) have a free edge (8a, 9a) extending transversely of the axial direction of said outflow passages (5, 6) and facing said foil bag (1, 2) and said free edge (8a, 9a) extends at least to the end surface (1a, 2a) of said foil bag (1, 2).

5. Foil bag package, as set forth in claim 1, wherein, said outflow passages (5, 6) each form a partial region of said discharge stub (7), an axially extending dividing wall (10) separating said outflow passages, and said piercing spatulas (8, 9) extend approximately perpendicularly to said dividing wall (10) and extend towards the oppositely located boundary wall (5a, 6a) of said outflow passages (5, 6).

6. Foil bag package, as set forth in claim 5, wherein said base parts (3, 4) have an axial plane of symmetry extending perpendicularly to said dividing wall (10), and said piercing spatulas (8, 9) are disposed symmetrically relative to the axial plane of symmetry.

7. Foil bag package for use in combination with a dispensing device for a two-component mortar mass comprises foil bags (1, 2) each having an elongated direction (A) and a dispensing end surface (1a, 2a) extending transversely of the elongated direction for each component of the mortar mass, said dispensing end having a center, a base part (3, 4) having a pair of side-by-side end sections (3, 4) each arranged to receive the dispensing end surface of one of said foil bags (1, 2) and having a center arranged to be aligned with the center of said foil bag received therein, said base part (3, 4) comprises a separate outflow passage (5, 6) for each of said end sections (3, 4), and a piercing device (8, 9) located in each of said end sections for opening the dispensing end surfaces (1*a*, 2*a*) of said foil bags (1, 2), said outflow passages (5, 6) each having a flow axis extending in the elongated direction of said foil bags and offset laterally from the center of the corresponding said end section of said base part (3, 4) for conveying said components to and through an axially extending discharge stub (7) open to and extending from said end sections, each of said piercing devices (8, 9) comprises two piercing spatulas (8, 9) disposed in parallel and laterally spaced relation, said two spatulas of each said piercing device (8, 9) being arranged in one of said end sections (3, 4) and extending in the elongated direction of said foil bags into said outflow passages (5, 6) and spaced outwardly from the center of the corresponding said end section, each said spatula having a first end located in said end section and a second end located in said outflow passage with said first and second ends spaced apart in the elongated direction of said foil bags and said first ends arranged to contact the dispensing end surface (1*a*, 2*a*) of said foil bags (1, 2) located in the corresponding said end section (3, 4) for rupturing the foil bags when pressure is applied to the foil bags by said dispensing device.

8. Foil bag package, as set forth in claim 7, wherein said outflow passages (5, 6) have a diameter and the lateral spacing (d) of said piercing spatulas (8, 9) is in the range of approximately one-third to two-thirds of the largest diameter of said outflow passages.

9. Foil bag package, as set forth in claim 8, wherein said discharge stub (7) has an outside wall, a dividing wall (10) extending in the elongated direction of said foil bags and extending chordally of the outside surface of said discharged stub, said outside surface of said discharge stub forming a boundary wall (5*a*, 6*a*) of said outflow passages (5, 6), said piercing spatulas in each said outflow passage having a narrow side extending between the first and second ends thereof and facing said boundary wall (5*a*, 6*a*) of said outflow passage (5, 6), said narrow side being shaped so that it extends approximately tangentially of said boundary wall (5*a*, 6*a*) of the said outflow passage (5, 6) and extends into the corresponding said end section (3, 4).

10. Foil bag package, as set forth in claim 7 wherein said outflow passages (5, 6) each form a partial region of said discharge stub (7), a dividing wall (10) extending in the elongated direction of said foil bags and separating said outflow passages (5, 6), and said piercing spatulas (8, 9) extend approximately perpendicularly to said dividing wall (10) and extend towards the oppositely located boundary wall (5*a*, 6*a*) of the said outflow passages (5, 6).

11. Foil bag package, as set forth in claim 10, wherein said base parts (3, 4) have an axial plane of symmetry extending perpendicularly to said dividing wall (10), and said piercing spatulas (8, 9) are disposed symmetrically relative to and on opposite sides of the axial plane of symmetry.

* * * * *